US009073354B2

(12) United States Patent
Ishimori

(10) Patent No.: US 9,073,354 B2
(45) Date of Patent: Jul. 7, 2015

(54) PRINTER CONTROL METHOD AND PRINTER

(71) Applicant: Seiko Epson Corporation, Tokyo (JP)

(72) Inventor: Hiroyuki Ishimori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 157 days.

(21) Appl. No.: 13/854,482

(22) Filed: Apr. 1, 2013

(65) Prior Publication Data

US 2013/0286128 A1 Oct. 31, 2013

(30) Foreign Application Priority Data

Mar. 30, 2012 (JP) ..... 2012-079650
Dec. 21, 2012 (JP) ..... 2012-279067

(51) Int. Cl.

| | |
|---|---|
| ***B41J 2/01*** | (2006.01) |
| ***B41J 13/00*** | (2006.01) |
| ***B41J 11/00*** | (2006.01) |
| ***B41J 11/06*** | (2006.01) |

(52) U.S. Cl.

CPC ..... *B41J 13/0009* (2013.01); *B41J 11/0085* (2013.01); *B41J 11/06* (2013.01)

(58) Field of Classification Search

USPC ..... 347/8, 16, 104
See application file for complete search history.

(56) References Cited

U.S. PATENT DOCUMENTS

| | | | | |
|---|---|---|---|---|
| 8,152,296 | B2 | 4/2012 | Maekawa et al. | |
| 8,322,845 | B2 | 12/2012 | Maekawa et al. | |
| 2011/0157288 | A1* | 6/2011 | Morimoto et al. | 347/104 |

FOREIGN PATENT DOCUMENTS

| | | |
|---|---|---|
| JP | 2010-201683 A | 9/2010 |

* cited by examiner

*Primary Examiner* — Matthew W Such
*Assistant Examiner* — Tuan A Hoang
(74) *Attorney, Agent, or Firm* — Nutter McClennen & Fish LLP; John J. Penny, Jr.; Derek P. Roller

(57) ABSTRACT

A printer has a fluid ejection head, an opening/closing mechanism that is disposed opposite the inkjet head, and suction holes arrayed in the conveyance direction of the recording paper, and opens and closes the suction holes. A printer control method has steps of detecting the position of the leading end of the recording paper before starting conveyance of the recording paper; reading the next recording paper conveyance speed Vpf; calculating a delay time Tdl for starting the opening/closing mechanism after recording paper conveyance starts based on the position of the leading end of the recording paper and the recording paper conveyance speed Vpf; determining the time when the opening/closing mechanism starts operating based on the delay time Tdl; and starting the opening/closing mechanism at the start time and opening the suction holes.

8 Claims, 11 Drawing Sheets

PRINTER CONTROL METHOD AND PRINTER

Priority is claimed under 35 U.S.C. §119 to Japanese Patent Application No. 2012-079650 filed on Mar. 30, 2012, and Japanese Patent Application No. 2012-279067 filed on Dec. 21, 2012, which are hereby incorporated by reference in their entireties.

BACKGROUND

1. Technical Field

The present invention relates to a method of controlling a printing device, and to a printing device that is controlled by this control method.

2. Related Art

Keeping the recording paper in contact with the platen surface that determines the printing position on the recording paper, and maintaining a highly precise platen gap, are essential to maintain print quality in printers that print on recording paper by ejecting ink droplets from an ink ejection head (printhead). Suction platens that hold the recording paper to the platen surface by means of suction while the recording paper is conveyed are therefore used in order to convey the recording paper in contact with the platen surface. But if the suction pressure is low, the recording paper may lift away from the platen surface and print quality may drop, or the recording paper may brush against the printhead and be soiled by the ink.

To address this problem, Japanese Unexamined Patent Appl. Pub. JP-A-2010-201683 discloses a printing device having a first suction area that is sectioned into a grid formed substantially in the middle of the platen width, which is perpendicular to the conveyance direction of the recording paper, and a second suction area formed on both sides of the first suction area. The first suction area has first suction holes formed in the bottoms of the grid chambers, and the second suction area has second suction holes that are shaped or arranged differently from the first suction holes in the first suction area. The first suction area is used primarily to hold narrow recording paper to the platen, and the first and second suction areas are used together to hold wide recording paper to the platen.

A problem with the printing device disclosed in JP-A-2010-201683 is that the suction holes outside the recording paper are also open and air flows therethrough even when narrow recording paper is used. Suction pressure is therefore lost, and sufficient suction cannot be achieved.

In addition, if there are suction holes not covered by the leading end of the recording paper, ink or other fluid droplets may be scattered by the suction current, and good print quality cannot be achieved.

SUMMARY

The present invention is directed to solving at least part of the foregoing problem by the embodiments described below.

One aspect of at least one embodiment of the invention is a control method for a printing device that has a fluid ejection head, a plurality of suction holes disposed in the recording paper conveyance direction opposite the fluid ejection head, and an opening/closing mechanism that opens and closes the suction holes, the control method including: detecting the position of the leading end of the recording paper before starting recording paper conveyance; reading the next recording paper conveyance speed; calculating a delay time for starting the opening/closing mechanism after recording paper conveyance starts based on the position of the leading end of the recording paper and the recording paper conveyance speed; determining the time when the opening/closing mechanism starts operating based on the delay time; and starting the opening/closing mechanism at the start time and opening the suction holes.

This aspect of the invention calculates the delay until the opening/closing mechanism starts operating after recording paper conveyance starts based on the position of the leading end of the recording paper and the next paper feed speed, determines the time when the opening/closing mechanism starts based on this delay time, starts the opening/closing mechanism at this start time, and opens the suction holes after the suction holes are covered by the recording paper. Ink or other fluid droplets are therefore not scattered by the suction current at the leading end of the recording paper because suction is applied to the recording paper only through suction holes in the area where the recording paper is present, and good print quality can be obtained.

In a printing device control method according to another aspect of at least one embodiment of the invention, the difference between the paper conveyance acceleration time after paper conveyance starts, and the time until the suction holes open after the opening/closing mechanism starts operating, is preferably set within a specific range of a target value.

Time is required for the conveyance (paper feed) speed to reach a constant speed (accelerate) after recording paper conveyance starts, and for the suction holes to open after the opening/closing mechanism starts moving. However, if the opening/closing mechanism is started so that the difference between the time when paper conveyance finishes accelerating and the time until the suction holes open after the opening/closing mechanism starts is within a specific range of a target value, recording paper conveyance and driving the opening/closing mechanism will substantially coincide, and the recording paper can be suctioned and pulled to the platen using only the suction holes where the recording paper is present.

Further preferably in a printing device control method according to another aspect of at least one embodiment of the invention, the step of calculating the delay time uses different equations when (A) the opening/closing mechanism starts operating after acceleration of recording paper conveyance ends, (B) the opening/closing mechanism starts operating during acceleration of recording paper conveyance, and the opening/closing mechanism finishes opening the suction holes after acceleration of recording paper conveyance ends, and (C) the opening/closing mechanism operating during acceleration of recording paper conveyance, and the opening/closing mechanism finishes opening the suction holes before acceleration of recording paper conveyance ends.

When printing, the start of recording paper conveyance and the start or end of opening/closing mechanism operation fit into these three patterns (A), (B), (C). Therefore, by using equations corresponding to these three patterns (modes), the delay time can be calculated to satisfy the specific conditions, and the opening/closing mechanism can be started at the appropriate time.

Further preferably in a printing device control method according to another aspect of at least one embodiment of the invention, the step of determining the start time uses the recording paper conveyance distance during acceleration of recording paper conveyance, and movement of the opening/closing mechanism until the suction holes open.

The recording paper conveyance (paper feed) speed (which can be substituted for the print speed) changes according to the print command. The start time of the opening/closing mechanism can therefore be determined using the conveyance speed, the length of paper conveyed during acceleration of the conveyance speed, and the movement of the opening/closing mechanism until the suction holes are open.

Yet further preferably in a printing device control method according to another aspect of at least one embodiment of the invention, the step of calculating the delay time uses parameter values extracted from a table containing the paper feed length during acceleration, the conveyance acceleration time, at selected conveyance speeds, and a table containing the amount driven until the suction holes open, and the time until the suction holes open, at each operating speed of the opening/closing mechanism.

Because the paper conveyance speed, paper conveyance acceleration time, and the time until the suction holes open are known values, tables containing these calculation parameters for each paper conveyance speed can be compiled in advance, and the delay can be easily calculated once the position of the leading end of the recording paper, the operating state of the opening/closing mechanism, and the paper conveyance speed are acquired.

Another aspect of at least one embodiment of the invention is a printing device comprising: a fluid ejection head; a platen disposed opposite the fluid ejection head with a plurality of suction holes formed in a matrix pattern in the recording paper conveyance direction; a suction mechanism that pulls the recording paper to the surface of the platen through the suction holes; an opening/closing mechanism that is disposed between the platen and the suction mechanism, opens the suction holes in the area covered by the recording paper, and closes the suction holes in the area not covered by the recording paper; a leading recording paper end detection unit that detects the position of the leading end of the recording paper; a start time determination unit that determines the timing when the opening/closing mechanism starts operating; and a control unit that calculates a delay time for starting the opening/closing mechanism after recording paper conveyance starts based on the position of the leading end of the recording paper and the recording paper conveyance speed, determines the time when the opening/closing mechanism starts operating based on the delay time, and starts the opening/closing mechanism at the start time and opens the suction holes.

This aspect of the invention calculates the delay until the opening/closing mechanism starts operating after recording paper conveyance starts based on the position of the leading end of the recording paper and the conveyance speed of the recording paper, determines the time when the opening/closing mechanism starts based on this delay time, starts the opening/closing mechanism at this start time, and opens the suction holes after the suction holes are covered by the recording paper. Ink or other fluid droplets are therefore not scattered by the suction current at the leading end of the recording paper because suction is applied to the recording paper only through suction holes in the area where the recording paper is present, and a printing device with good print quality can be achieved.

In a printing device according to another aspect of at least one embodiment of the invention, the control unit sets the difference between the paper conveyance acceleration time after paper conveyance starts, and the time until the suction holes open after the opening/closing mechanism starts operating, within a specific range of a target value.

Time is required for the conveyance (paper feed) speed to reach a constant speed (accelerate) after recording paper conveyance starts, and for the suction holes to open after the opening/closing mechanism starts moving. However, if the opening/closing mechanism is started so that the difference between the time when paper conveyance finishes accelerating and the time until the suction holes open after the opening/closing mechanism starts is within a specific range of a target value, recording paper conveyance and driving the opening/closing mechanism will substantially coincide, and the recording paper can be suctioned and pulled to the platen using only the suction holes where the recording paper is present.

Further preferably in a printing device according to another aspect of at least one embodiment of the invention, the control unit determines the start time based on the recording paper conveyance distance during acceleration of recording paper conveyance, and movement of the opening/closing mechanism until the suction holes open.

The recording paper conveyance (paper feed) speed (which can be substituted for the print speed) changes according to the print command. The start time of the opening/closing mechanism can therefore be determined using the conveyance speed, the length of paper conveyed during acceleration of the conveyance speed, and the movement of the opening/closing mechanism until the suction holes are open.

Yet further preferably in a printing device according to another aspect of at least one embodiment of the invention, the control unit compiles a table containing the paper feed length during acceleration, and the conveyance acceleration time, at selected conveyance speeds, and a table containing the amount driven until the suction holes open, and the time until the suction holes open, at each operating speed of the opening/closing mechanism; and calculates the delay time using parameter values extracted from the tables.

Because the paper conveyance speed, paper conveyance acceleration time, and the time until the suction holes open are known values, tables containing these calculation parameters for each paper conveyance speed can be compiled in advance, and the delay can be easily calculated once the position of the leading end of the recording paper, the operating state of the opening/closing mechanism, and the paper conveyance speed are acquired.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Note that parts shown in the accompanying figures are sized for easy recognition of the different parts, and various members and parts are not necessarily drawn to actual scale.

Printer: Generation Configuration

The printing device according to this embodiment of the invention is described with reference to a roll paper printer having a suction mechanism for pulling the recording paper to the platen.

Figure 1:
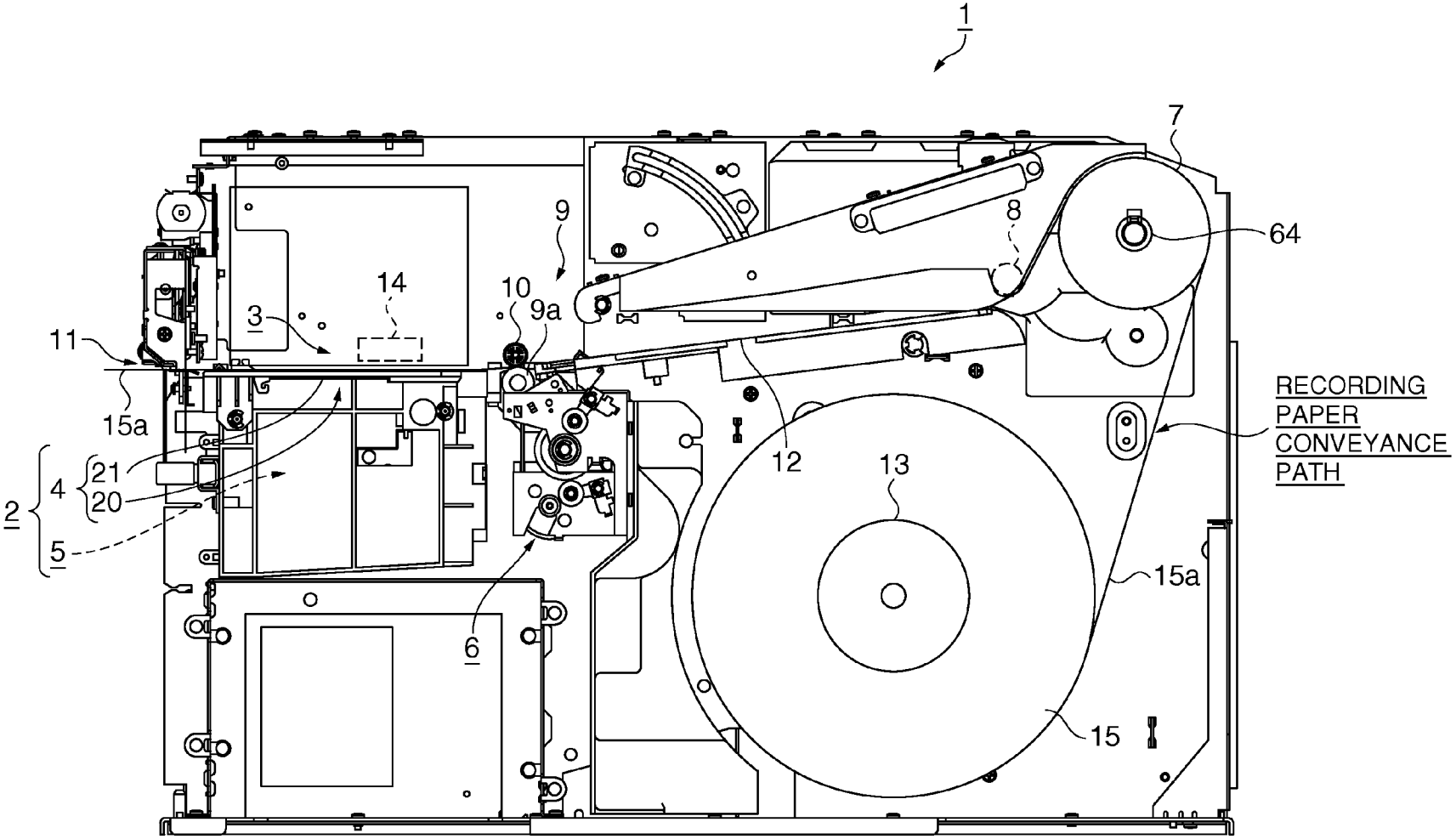
FIG. 1 shows the general internal configuration of a printing device according to the invention.

FIG. 1 shows the general configuration of the inside of a printer according to this embodiment of the invention. The main components of this printer 1 are a main print unit and a recording paper conveyance unit.

The main print unit includes a liquid droplet ejection head 3, a platen unit 2 including a platen 21 and opening/closing mechanism 20 disposed opposite the inkjet head 3 with the recording paper 15*a* therebetween, a suction unit 5 for suctioning the recording paper 15*a* to the platen surface through suction holes formed in the platen 21, and a paper width (PW) detection sensor 14 that moves with the inkjet head 3 and measures the width of the recording paper 15*a*.

The liquid droplet ejection head 3 in this embodiment is an inkjet head as known from the literature, and further description thereof is omitted.

Parts of the platen unit 2 are described in detail below with reference to FIG. 2 to FIG. 5.

The configuration of the recording paper conveyance unit along the recording paper conveyance path is described next.

The roll paper 15 is first set on a roll paper drive shaft 13. The roll paper 15 is then conveyed by a feed roller 7, guide roller 8, and paper feed mechanism drive unit 6, and discharged from a paper exit 11.

Note that below the print area of the roll paper 15 on the platen 21 is referred to and described as recording paper 15*a* below.

A roll paper shaft drive motor (not shown in the figure) is connected to the roll paper drive shaft 13, and is driven when rewinding the roll paper 15 (back-feeding or reverse conveyance).

The paper feed mechanism drive unit 6 includes a paper feed roller 9, a pressure roller 10 that presses the recording paper 15*a* to the paper feed roller 9, and a paper feed motor 9*a* that rotationally drives the paper feed roller 9. Note that the pressure roller 10 separates from the paper feed roller 9 when rewinding the roll paper 15.

A rotary encoder (not shown in the figure) is disposed on the paper feed mechanism drive unit 6 and roll paper drive shaft 13 (or the drive motors thereof). The conveyance speed and conveyance distance of the recording paper 15*a* are detected using output from the rotary encoder. The rotary encoder on the paper feed mechanism drive unit 6 side is used to detect the conveyance speed and conveyance distance during forward conveyance, and the rotary encoder on the roll paper drive shaft 13 side is used during reverse conveyance.

A roll paper guide 12 is disposed between the guide roller 8 and paper feed roller 9. The roll paper guide 12 controls the widthwise position of the roll paper 15, and functions to keep the recording paper 15*a* substantially centered to the platen 21 width regardless of the width of the roll paper 15.

Printer: Configuration of the Platen Unit

The configuration of the platen unit 2 is described next.

Figure 2:
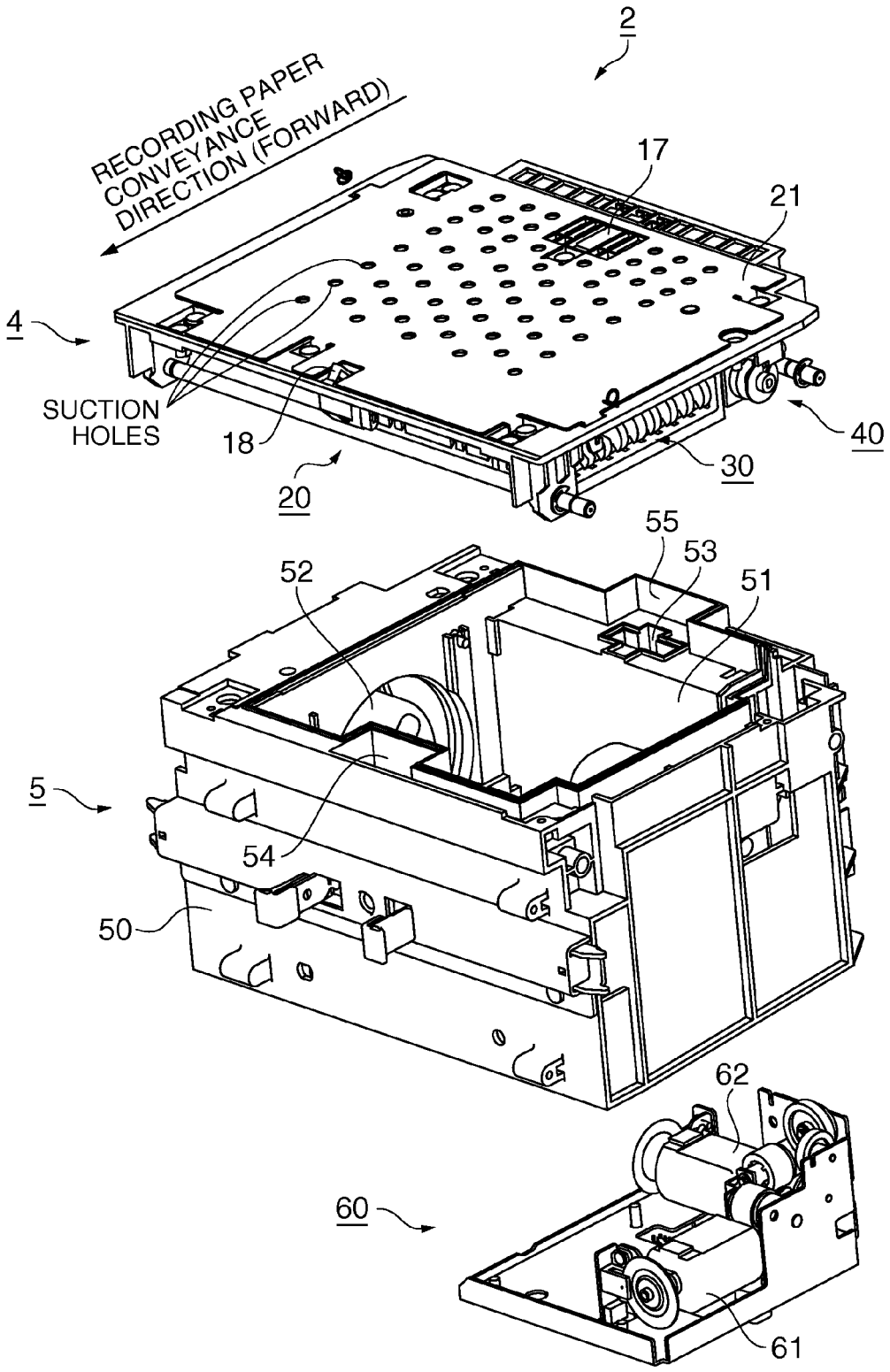
FIG. 2 is an exploded oblique view of the platen unit.

FIG. 2 is an exploded oblique view of the platen unit 2. The platen unit 2 has a platen mechanism unit 4 including the platen 21 and opening/closing mechanism 20, the suction unit 5, and an open/close drive unit 60.

The platen 21 is the top surface of the platen mechanism unit 4 as seen in the figures. A recording paper position detection sensor 17 that detects the start printing reference position of the recording paper 15*a* is disposed exposed from the platen surface on the upstream side (the side from which conveyance starts) of the recording paper conveyance direction (forward conveyance). A leading end position detection unit 18 that detects the position of the leading end of the recording paper is disposed exposed from the platen surface at the downstream end in the recording paper conveyance direction.

A first cam group 30 that drives sliding a paper feed (PF) shutter plate (see FIG. 4) in the recording paper conveyance direction, and a second cam group 40 that is disposed perpendicularly to the first cam group 30 and drives rocking a paper width (PW) shutter plate described below (FIG. 4), are disposed on the back side of the platen 21. The PF shutter plate and the first cam group 30, and the PW shutter plate and the second cam group 40, are housed in the space (suction chamber 51) inside the suction unit 5.

The suction unit 5 has a suction chamber 51 inside a case 50, and a suction fan 52 that discharges air inside the suction chamber 51 to the outside. A sensor housing 53 that houses the recording paper position detection sensor 17, and a sensor housing 54 that houses the leading end position detection unit 18, are formed in the case 50 near the top edge. The open/close drive unit 60 is housed inside the suction chamber 51 of the suction unit 5.

The open/close drive unit 60 includes a PF shutter motor 62 that rotationally drives the first cam group 30, and a PW shutter motor 61 that rotationally drives the second cam group 40.

A plurality of suction holes are formed in a matrix pattern along the recording paper 15*a* conveyance direction and the paper width direction perpendicular to the conveyance direction. The arrangement of these suction holes is described with reference to FIG. 3.

Figure 3:
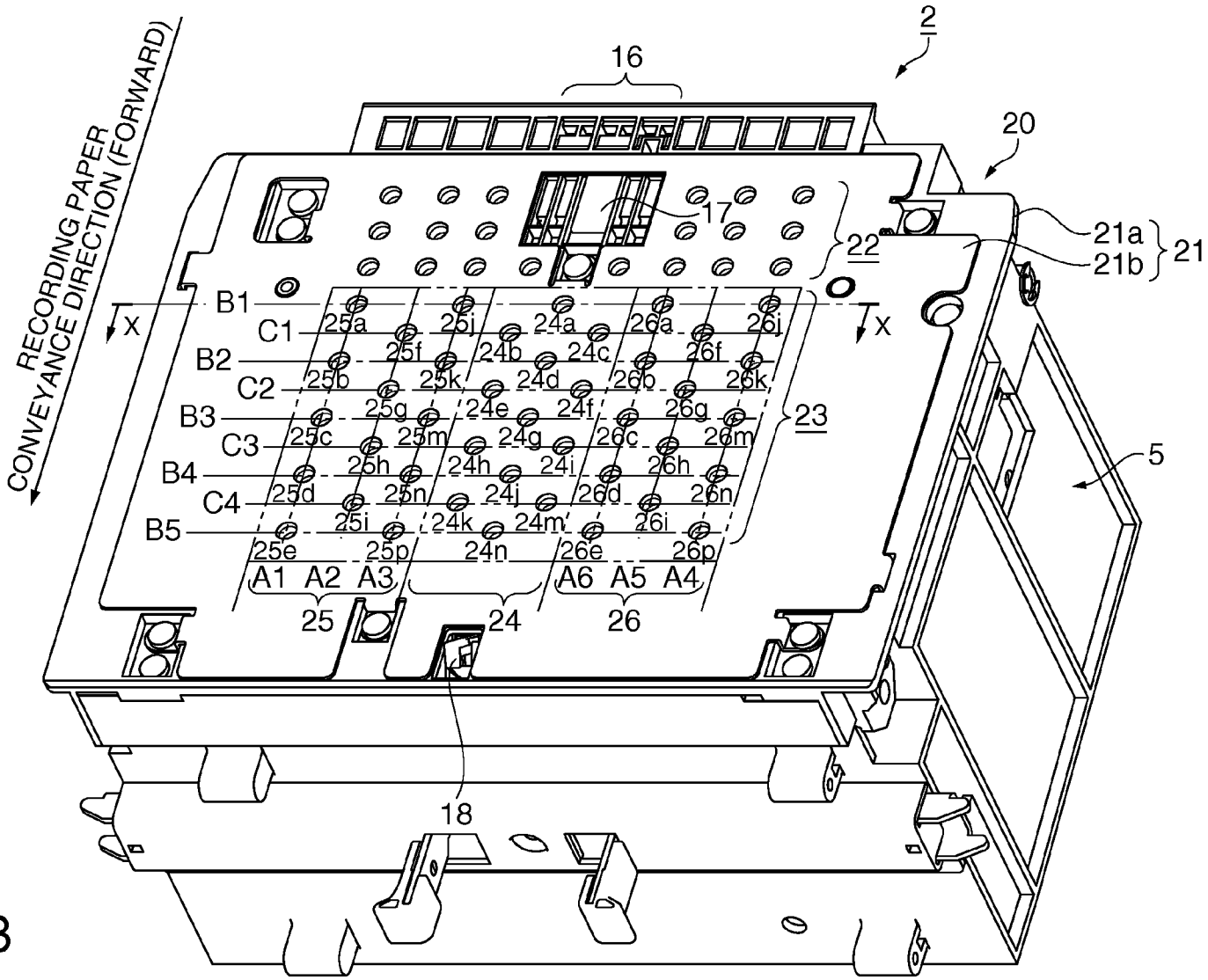
FIG. 3 shows the arrangement of the suction holes opened in the platen.

FIG. 3 shows the arrangement of the suction holes formed in the platen. Note also that FIG. 3 shows the entire platen unit 2. The platen 21 includes a platen base 21*a* and platen top 21*b* stacked and fastened together, the plural suction holes pass through both members, and the platen base 21*a* and platen top 21*b* are therefore referred to together as the platen 21 below.

The suction holes are divided into a suction area 22 on the upstream side in the recording paper conveyance direction (forward conveyance) and a suction area 23 on the downstream side in the forward conveyance direction. Suction area 22 is an area that does not open and close, and is used to provide suction until the recording paper 15*a* reaches the upstream position where detection by the recording paper position detection sensor 17 is possible. Suction area 23 is an area where suction holes are opened and closed while printing.

The suction holes in suction area 23 are further grouped in the recording paper conveyance direction into a first suction area 24 opened in the middle of the recording paper 15*a*, a second suction area 25 that opens on the left side of the first suction area 24 as seen in the figure, and a third suction area 26 that opens on the right side of the first suction area 24 as seen in the figure. The rows of suction holes formed along the recording paper conveyance direction are referred to herein as longitudinal rows. As a result, nine longitudinal rows of suction holes are formed across the width of the recording paper 15*a* as shown in FIG. 3.

Suction holes 24*a* to 24*n* are formed in the first suction area 24. In this embodiment the first suction area 24 are disposed in the area corresponding to the shortest width of recording paper 15*a* expected to be used.

In the second suction area 25, suction holes are formed in rows A1, A2, A3 from the left side in the figure to the center with suction holes 25*a*-25*e* formed in row A1, suction holes 25*f*-25*i* in row A2, and suction holes 25*j*-25*p* in row A3.

In the third suction area 26, suction holes are formed in rows A4, A5, A6 from the right side in the figure toward the center with suction holes 26*j*-26*p* formed in row A4, suction holes 26*f*-26*i* in row A5, and suction holes 26*a*-26*e* in row A6.

The arrangement of the suction holes in lateral rows is described next. The suction holes are arranged in lateral rows as well as the longitudinal rows described above. Groups of plural suction holes arranged across the width of the recording paper 15*a* are referred to as lateral rows of suction holes, and nine lateral rows labeled rows B1 to B5 and rows C1 to C4 alternate in the conveyance direction as shown in the figure.

The arrangement of suction holes in these lateral rows includes suction holes 25*a*, 25*j*, 24*a*, 26*a*, 26*j* in row B1, suction holes 25*b*, 25*k*, 24*d*, 26*b*, 26*k* in row B2, suction holes 25*c*, 25*m*, 24*g*, 26*c*, 26*m* in row B3, suction holes 25*d*, 25*n*, 24*j*, 26*d*, 26*n* in row B4, and suction holes 25*e*, 25*p*, 24*n*, 26*e*, 26*p* in row B5.

Row C1 includes suction holes 25*f*, 24*b*, 24*c*, 26*f*, row C2 includes suction holes 25*g*, 24*e*, 24*f*, 26*g*, row C3 includes suction holes 25*h*, 24*h*, 24*i*, 26*h*, and row C4 includes suction holes 25*i*, 24*k*, 24*m*, 26*i*.

The suction holes are therefore arranged in a matrix of longitudinal and lateral rows as shown in FIG. 3. The second suction area 25 of longitudinal rows A1, A2, A3, and the third suction area 26 of longitudinal rows A4, A5, A6, communicate with or are closed to the air chamber (see FIG. 5) by the PW shutter plates 101 to 106 (see FIG. 4) as described below.

The lateral rows B1, B2, B3, B4, B5 are opened and closed by a first PF shutter plate group 70 described below, and lateral rows C1, C2, C3, C4 are opened and closed by a second PF shutter plate group 80.

A black mark sensor 16 is disposed on the upstream side of the platen 21 in the recording paper 15*a* conveyance direction. When roll paper having labels affixed to a web backer is used, the black mark sensor 16 detects black marks denoting the printing position of each label. The black mark sensor 16 is placed inside a sensor housing unit 55 (see FIG. 2) when the suction unit 5 and platen unit 2 are assembled.

Printer: Configuration of the Opening/Closing Mechanism

The opening/closing mechanism is described next with reference to FIG. 4.

Figure 4:
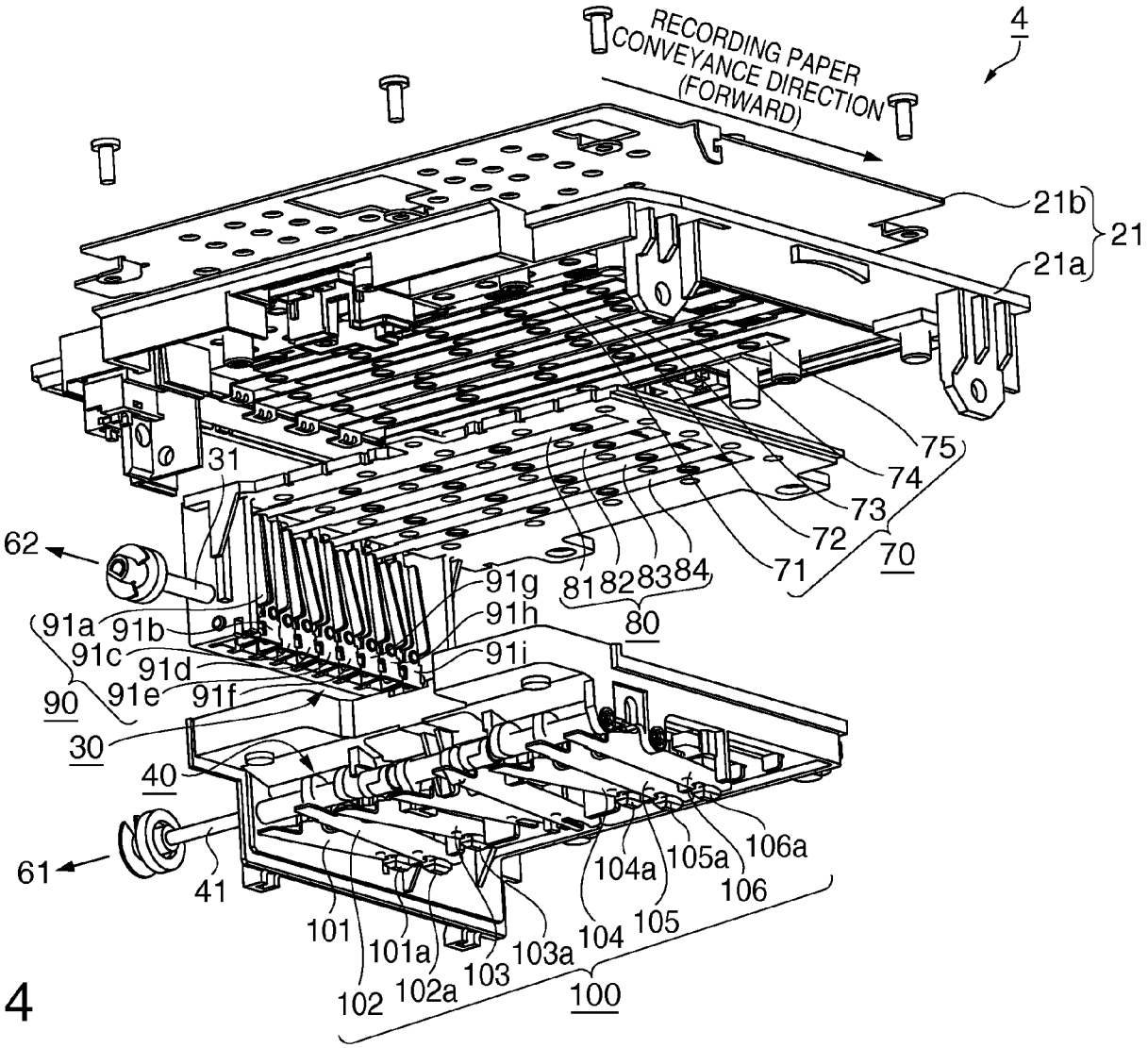
FIG. 4 is an exploded oblique view of the opening and closing mechanism.

FIG. 4 is an exploded oblique view of the opening/closing mechanism. The opening/closing mechanism 20 includes the first PF shutter plate group 70 located below the platen 21, the second PF shutter plate group 80 located below the first PF shutter plate group 70, and a PW shutter plate group 100 located below the second PF shutter plate group 80.

The platen 21 includes the platen base 21*a* and a platen top 21*b* fastened to the top of the platen base 21*a*, and the plural suction holes shown in FIG. 3 pass through both the platen base 21*a* and platen top 21*b*.

The first PF shutter plate group 70 is composed of five PF shutter plates 71, 72, 73, 74, 75 disposed perpendicularly to the recording paper conveyance direction and parallel to each other with a specific gap therebetween from the upstream side of the conveyance direction. The PF shutter plates 71, 72, 73, 74, 75 can move independently of each other forward and back perpendicularly to the recording paper conveyance direction.

The second PF shutter plate group 80 includes four PF shutter plates 81, 82, 83, 84 disposed perpendicularly to the recording paper conveyance direction and parallel to each other with a specific gap therebetween from the upstream side of the conveyance direction. The PF shutter plates 81, 82, 83, 84 are inserted between the first PF shutter plates 71, 72, 73, 74, 75, and can move forward and back perpendicularly to the recording paper conveyance direction.

Opening and closing the suction holes by the first PF shutter plate group 70 and second PF shutter plate group 80 is described next with reference to FIG. 3 and FIG. 4.

In this embodiment PF shutter plate 71 opens and closes the suction holes in row B1, PF shutter plate 72 opens and closes the suction holes in row B2, PF shutter plate 73 opens and closes the suction holes in row B3, PF shutter plate 74 opens and closes the suction holes in row B4, and PF shutter plate 75 opens and closes the suction holes in row B5.

In addition, PF shutter plate 81 opens and closes the suction holes in row C1, PF shutter plate 82 opens and closes the suction holes in row C2, PF shutter plate 83 opens and closes the suction holes in row C3, and PF shutter plate 84 opens and closes the suction holes in row C4.

The first PF shutter plate group 70 and second PF shutter plate group 80 are driven by operating lever group 90 composed of nine operating levers, and the first cam group 30. The first cam group 30 is turned by a cam shaft 31 connected to the PF shutter motor 62 of the open/close drive unit 60 (see FIG. 2).

The first cam group 30 includes nine cams not shown. These cams are labeled cam 30*a* to cam 30*i* from the motor-side end of the cam shaft 31. Cam 30*a* causes PF shutter plate 71 to slide by means of operating lever 91*a*, cam 30*b* causes PF shutter plate 81 to slide by means of operating lever 91*b*, cam 30*c* causes PF shutter plate 72 to slide by means of operating lever 91*c*, cam 30*d* causes PF shutter plate 82 to slide by means of operating lever 91*d*, cam 30*e* causes PF shutter plate 73 to slide by means of operating lever 91*e*, cam 30*f* causes PF shutter plate 83 to slide by means of operating lever 91*f*, cam 30*g* causes PF shutter plate 74 to slide by means of operating lever 91*g*, cam 30*h* causes PF shutter plate 84 to slide by means of operating lever 91*h*, and cam 30*i* causes PF shutter plate 75 to slide by means of operating lever 91*i* widthwise to the recording paper 15*a* to open and close the suction holes sequentially in the recording paper conveyance direction.

More specifically, when the recording paper 15*a* is conveyed forward, the alternately disposed first PF shutter plate group 70 and second PF shutter plate group 80 sequentially open the suction holes in lateral rows from B1 to C1, B2, C2, . . . B5, and when the recording paper is reversed, sequentially close the suction holes in lateral rows from row B5 to C4, B4, C3, B3, . . . B1.

Note that the phase difference of cams 30*a* to 30*i* is determined according to the recording paper conveyance speed and conveyance distance (movement distance) to open or close the suction holes in lateral rows in the above order.

The configuration of the PW shutter plate group 100 is described next with reference to FIG. 4 and FIG. 3. The PW shutter plate group 100 is composed of six PW shutter plates 101, 102, 103, 104, 105, 106 disposed parallel to each other widthwise to the recording paper 15*a*. The PW shutter plates 101, 102, 103, 104, 105, 106 can rock to the platen 21 surface independently of each other.

A valve that opens and closes the air chamber (see FIG. 5) is inserted on each PW shutter plate 101 to 106. Valve 101*a* is disposed on PW shutter plate 101, valve 102*a* on PW shutter plate 102, valve 103*a* on PW shutter plate 103, valve 104*a* on PW shutter plate 104, valve 105*a* on PW shutter plate 105, and valve 106*a* on PW shutter plate 106. Opening and closing the air chamber is described with reference to FIG. 5 below.

The PW shutter plate group 100 is driven by the second cam group 40. The second cam group 40 is rotated by a cam shaft 41 connected to the PW shutter motor 61 of the open/close drive unit 60 (see FIG. 2).

While not described individually below, the second cam group 40 is composed of 6 cams 40*a*, 40*b*, 40*c*, 40*d*, 40*e*, 40*f* from the PW shutter motor 61 side end, with cam 40*a* rocking PW shutter plate 101, cam 40*b* rocking PW shutter plate 102, cam 40*c* rocking PW shutter plate 103, cam 40*d* rocking PW shutter plate 104, cam 40*e* rocking PW shutter plate 105, and cam 40*f* rocking PW shutter plate 106 to the platen 21.

The configuration of the PW shutter plate group 100 is described next. PW shutter plate 101 and PW shutter plate 106 are disposed on the opposite outside sides of the recording paper 15*a* width, PW shutter plate 102 and PW shutter plate 105 are located to the inside of the paper width therefrom, and PW shutter plate 103 and PW shutter plate 104 are located furthest to the inside of the paper width.

The PW shutter plate group 100 works with the first PF shutter plate group 70 and second PF shutter plate group 80 to open and close the suction hole-air chamber-suction chamber paths, and the PW shutter plate group 100 handles opening and closing the air chambers and suction chambers.

The suction hole areas that are opened and closed by the PW shutter plate group 100 are described next with reference to FIG. 3. PW shutter plate 101 opens and closes the suction holes in row A4, PW shutter plate 106 opens and closes the suction holes in row A1, and rows A4 and A1 open and close at the same time.

PW shutter plate 102 opens and closes the suction holes in row A5, PW shutter plate 105 opens and closes the suction holes in row A2, and rows A5 and A2 open and close at the same time.

PW shutter plate 103 opens and closes the suction holes in row A6, PW shutter plate 104 opens and closes the suction holes in row A3, and rows A6 and A3 open and close at the same time.

A separate air chamber is therefore provided for each row A1, A2 A3, A4, A5, A6 of suction holes.

Opening and closing the suction holes by means of the first PF shutter plate group 70, second PF shutter plate group 80, and PW shutter plate group 100 is described next with reference to the figures.

Figure 5:
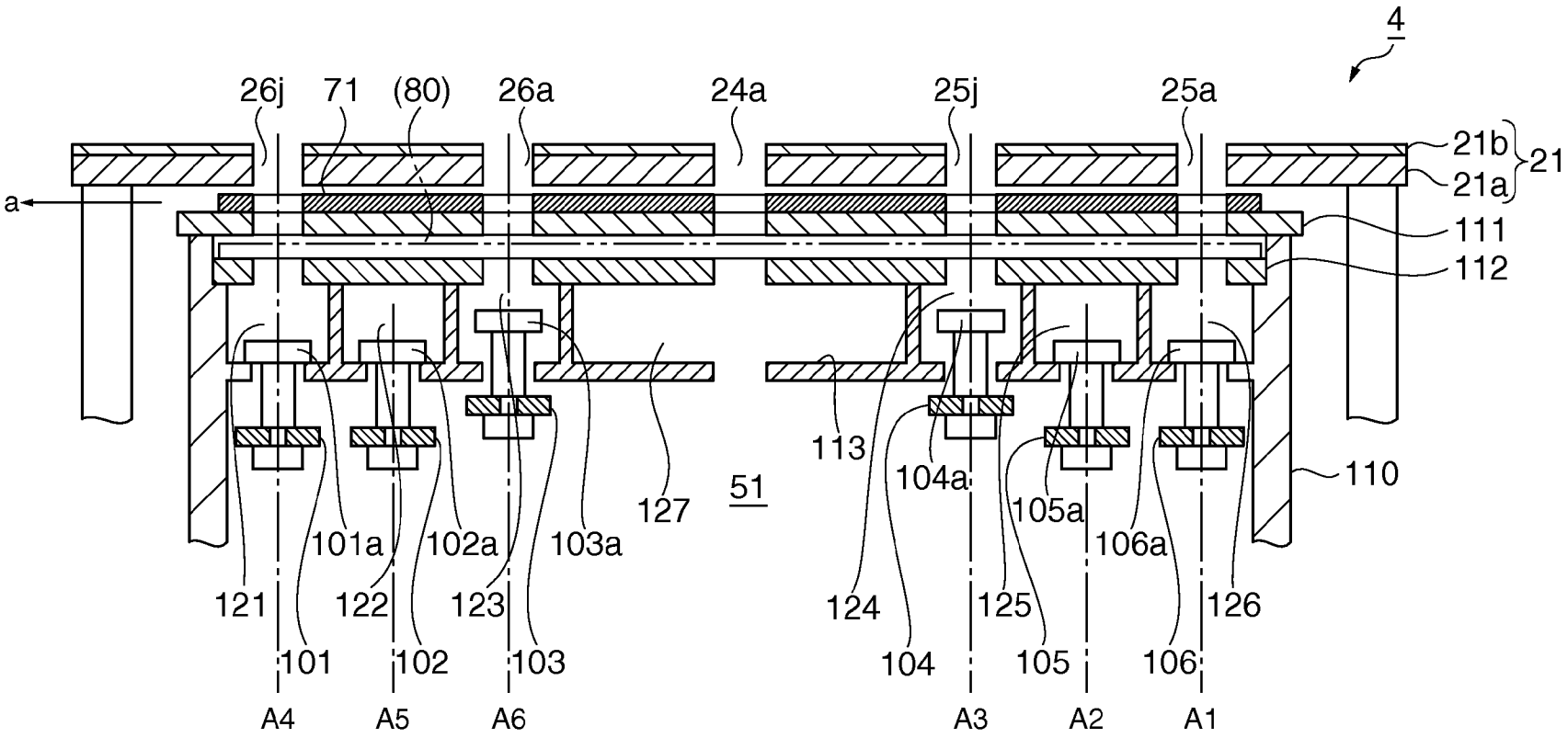
FIG. 5 schematically describes part of the opening and closing action of the suction holes.

FIG. 5 is a section view showing the suction hole opening and closing operation in part. FIG. 5 is a section view through line X-X in FIG. 3 through the suction holes in row B1.

As shown in FIG. 5, disposed in layers from top down from the bottom of the platen 21 having the suction holes for suctioning the recording paper 15*a* are the first PF shutter plate 71 and a first shutter plate 111 that supports the position of the PF shutter plate 71 in the thickness direction in a first layer; and a second layer that is below the first shutter plate 111 and includes the second PF shutter plate group 80 and a second shutter plate 112 that together with the first shutter plate 111 supports the position of the second PF shutter plate group 80 in the thickness direction. A third shutter plate 113 is further disposed below the second shutter plate 112. The first shutter plate 111, second shutter plate 112, and third shutter plate 113 may be fastened to a shutter holder 110, or formed in unison.

Seven air chambers 121, 122, 123, 124, 125, 126, 127 are formed between the second shutter plate 112 and third shutter plate 113. A path (through-hole) to each suction hole opening in the platen 21 is formed through the first shutter plate 111 and second shutter plate 112.

Air chamber 126 communicates with all suction holes in row A1, air chamber 125 with all suction holes in row A2, air chamber 124 with all suction holes in row A3, and air chamber 127 with all suction holes in the first suction area 24. Air chamber 123 communicates with all suction holes in row A6, air chamber 122 with all suction holes in row A5, and air chamber 121 with all suction holes in row A4.

Valves 101*a* to 106*a* are inserted in the through-holes connecting air chambers 121 to 126 with the suction chamber 51. More specifically, valve 101*a* is disposed in air chamber 121, valve 102*a* in air chamber 122, valve 103*a* in air chamber 123, valve 104*a* in air chamber 124, valve 105*a* in air chamber 125, and valve 106*a* in air chamber 126.

As described above, the valves move up and down by the rocking action of the PW shutter plate, thereby opening and closing the paths between the corresponding air chambers and suction chamber.

A valve is not disposed in the air chamber 127. As a result, opening and closing the air chamber 127 and suction holes in the first suction area 24 is controlled by the first PF shutter plate group 70 in the first layer and the second PF shutter plate group 80 in the second layer.

Because lateral row B1 and longitudinal rows A3 and A6 are shown open in FIG. 5, suction holes 26*a*, 24*a*, 25*j* communicate with suction chamber 51 and can pull the recording paper 15*a* to the platen 21. Sliding PF shutter plate 71 in the direction of arrow a closes the suction holes in row B1.

The first PF shutter plate group 70 in the first layer and second PF shutter plate group 80 in the second layer thus open and close the suction holes in lateral rows according to the position of the leading end of the recording paper 15*a* in the conveyance direction, and the PW shutter plate group 100 opens and closes the suction holes in longitudinal rows according to the width of the recording paper 15*a*.

The configuration of the control system of the printer 1 is described next.

Figure 6:
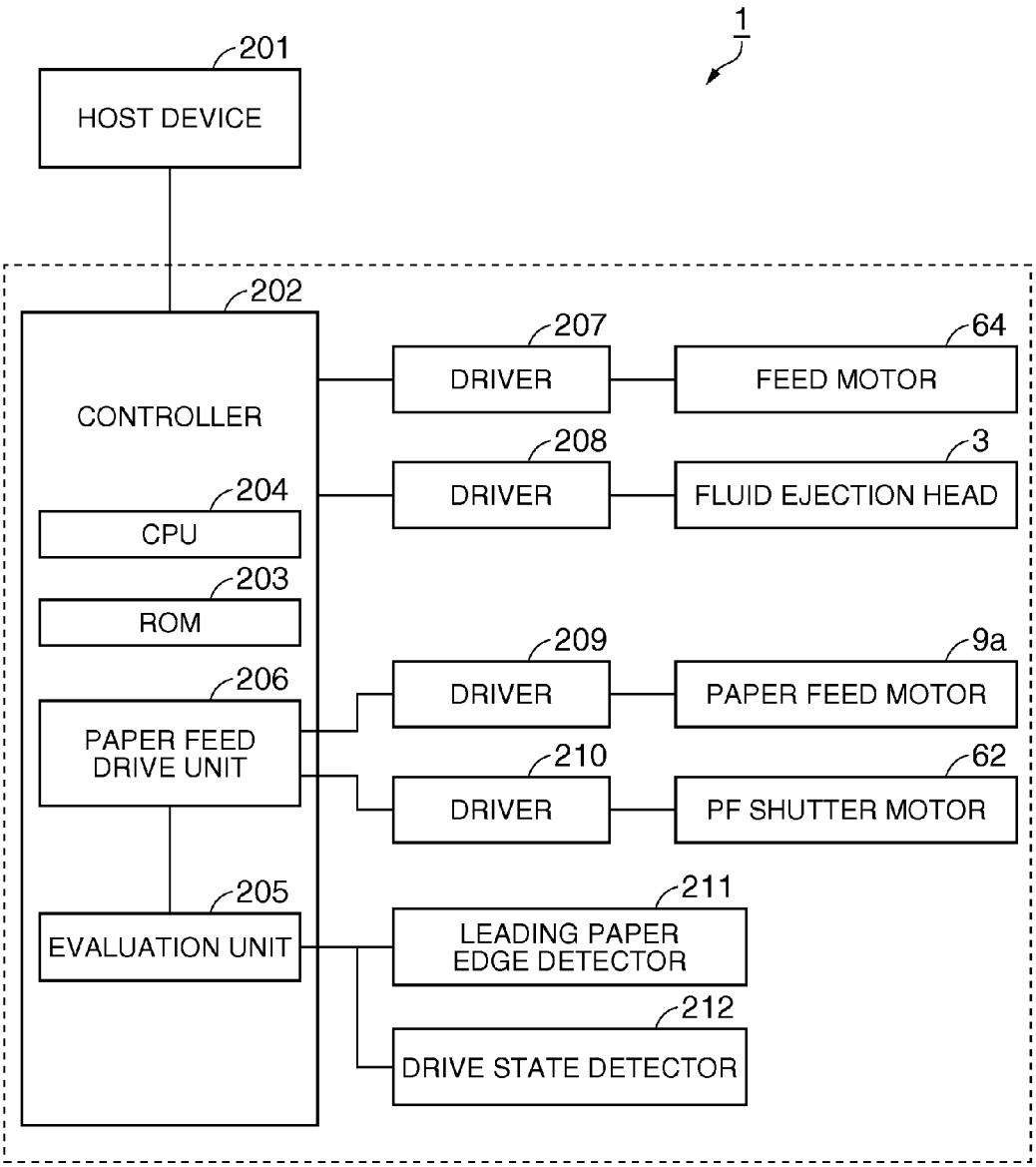
FIG. 6 is a block diagram showing the main parts of the control system of the printing device.

FIG. 6 is a block diagram showing the main parts of the control system of the printer 1. The printer 1 includes a controller 202 and various drivers. The controller 202 includes a CPU 204 that controls the printer 1 system, ROM 203 as a memory device, and an evaluation unit 205 that evaluates states (A), (B), and (C) described below based on information from a leading paper edge detector 211 and a drive state detector 212 that detects the positions of the PF shutter plate groups 70 and 80.

The drivers include a driver 207 that controls a feed motor 64 to drive the feed roller 7; a driver 208 that controls driving the inkjet head 3; a driver 209 that controls driving the paper feed motor 9*a*; and a driver 210 that controls driving the PF shutter motor 62.

The printer 1 also has a leading paper edge detector 211. The leading paper edge detector 211 includes the leading end position detection unit 18 disposed on the downstream side of the recording paper 15*a* in the conveyance direction, and the recording paper position detection sensor 17 that detects the start printing reference position at the upstream side in the conveyance direction. As shown in FIG. 1, the recording paper 15*a* is conveyed in the forward conveyance direction by the paper feed roller 9, and the paper feed roller 9 is driven by the paper feed motor 9*a*. The recording paper 15*a* is conveyed in reverse by the feed roller 7, and the feed roller 7 is driven by the feed motor 64. The opening/closing mechanism 20 also includes the PF shutter motor 62 that drives the second cam group 40 to open and close the suction holes in lateral rows B1 to B5 and C1 to C4.

A rotary encoder is disposed on the paper feed motor 9*a* and the feed motor 64, and the conveyance direction, conveyance speed, and conveyance distance of the recording paper can be detected using these rotary encoders.

The position of the leading end of the recording paper 15*a* immediately before printing starts can be determined using the leading end position detection unit 18, recording paper position detection sensor 17, and the rotary encoders disposed in the paper feed motor 9*a* and feed motor 64.

A rotary encoder is also disposed on the PF shutter motor 62, and the state of the PF shutter plate group 70 can be detected using this rotary encoder. More specifically, the open or closed states of the lateral rows of suction holes can be determined.

Printer Control Method

Controlling suction of the recording paper is described next with reference to the accompanying flow charts and FIG. 1 to FIG. 5.

Suction control before starting printing to the recording paper 15*a* is described first.

Figure 7A:
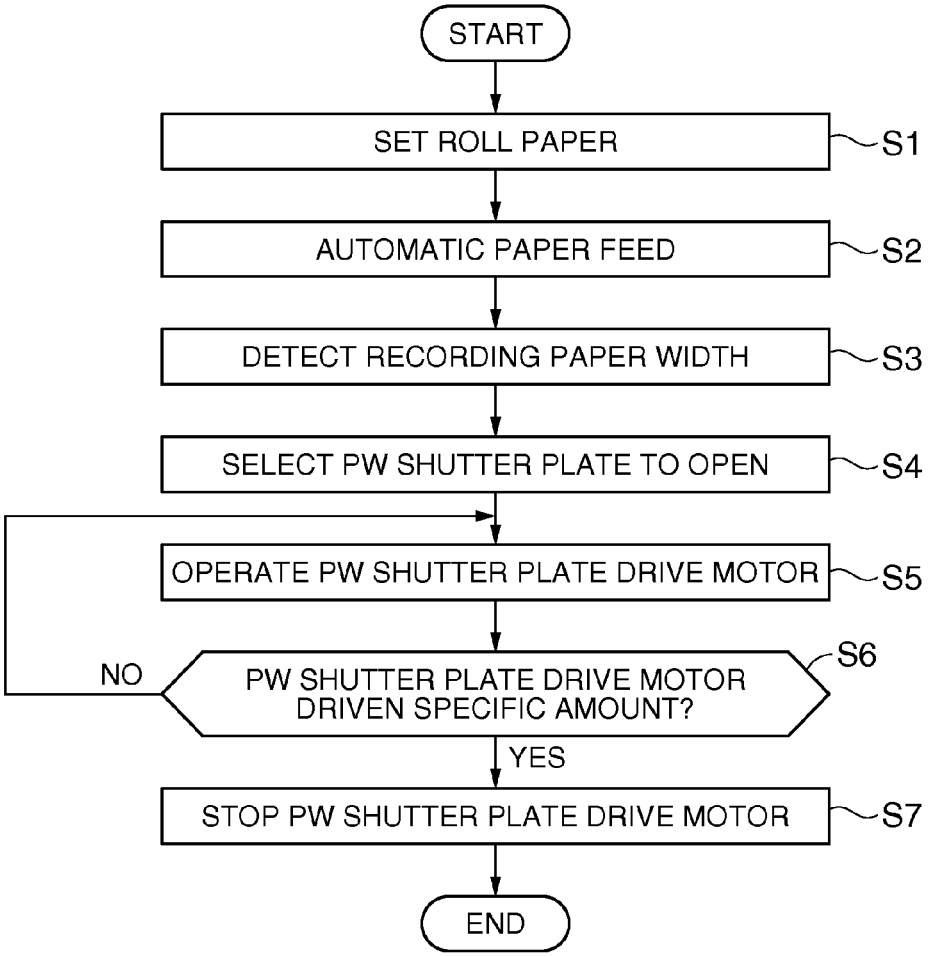
FIGS. 7A and 7B are flow charts of the method used to determine the open area of the suction holes based on the width of the recording paper.
Figure 7B:
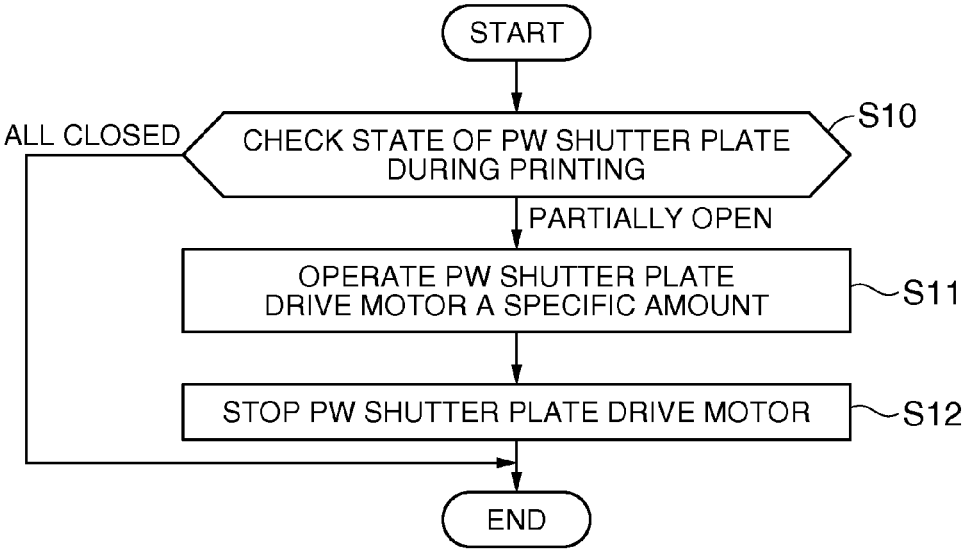

FIGS. 7A and 7B are flow charts of the process determining the suction hole areas to be opened or closed according to the width of the recording paper, FIG. 7A showing the steps during forward paper feed (forward conveyance) and FIG. 7B showing the steps during back-feeding (reverse conveyance).

Forward paper feed is described first. Operation begins with loading the roll paper 15 onto the roll paper drive shaft 13 in preparation for printing (step S1). Next, the recording paper 15*a* is advanced automatically to the platen 21 surface (step S2).

Next, the width of the recording paper 15*a* is detected by the paper width detection sensor 14 (step S3). This is done by moving the paper width detection sensor 14 across the paper width, detecting the edges of the recording paper 15*a*, and calculating the width.

The PW shutter plates to be opened are then determined according to the paper width (step S4).

For example, if the recording paper 15*a* width is within the first suction area 24, closing all of the PW shutter plates 101 to 106 in the second suction area 25 and third suction area 26 is selected. Note that opening and closing the suction holes in the first suction area 24 is controlled with the first PF shutter plate group 70 and second PF shutter plate group 80.

When the width of the recording paper 15*a* is between longitudinal suction hole rows A2 and A3, and A5 and A6, the recording paper 15*a* covers rows A3 and A6, the PW shutter plates are selected to open the suction holes in rows A3 and A6. In this embodiment, PW shutter plates 103 and 104 are selected.

When the width of the recording paper 15*a* is between longitudinal suction hole rows A1 and A2, and A4 and A5, the recording paper 15*a* covers rows A2 and A3, and A5 and A6, the PW shutter plates are selected to open the suction holes in rows A2 and A3, and A5 and A6. In this embodiment, PW shutter plates 102, 103, 104, 105 are selected.

When the width of the recording paper 15*a* is outside longitudinal suction hole rows A1 and A4 (when wide paper is loaded), the recording paper 15*a* covers all suction holes in the first suction area 24, second suction area 25, and third suction area 26, and the PW shutter plates are selected to open the suction holes in longitudinal rows A1 to A6. In this embodiment, PW shutter plates 101, 102, 103, 104, 105, and 106 are selected.

After selecting the PW shutter plates to open, the PW shutter plate drive motor 61 is driven (step S5).

Whether the PW shutter plate drive motor 61 was driven the specified amount is then detected (step S6). More specifically, whether the selected PW shutter plates were driven to the position opening the suction holes to be opened is determined. A rotary encoder disposed in the motor 61, for example, is used to detect the driven amount.

If the motor 61 has not driven the specified amount (NO), driving the motor 61 continues until the specified amount is reached. When the specified amount is reached (YES), the PW shutter plate drive motor 61 stops (step S7), and this operation ends.

Control when the recording paper is reversed to the start printing position after the PW shutter plate opens specific longitudinal rows of suction holes is described next with reference to FIG. 7B.

The positions of the PW shutter plates are checked (step S10) after the PW shutter plate drive motor 61 is stopped (step S7) as described in FIG. 7A. More specifically, which suction holes in the PW shutter plate were open while printing is checked.

If the suction holes in all PW shutter plates are closed (all closed), the recording paper 15*a* can be reversed immediately. This means that the suction holes in the second suction area 25 and third suction area 26 are all closed, and the suction holes in the first suction area 24 are open. As a result, the suction holes in the first suction area 24 are open during back-feeding regardless of the width of the recording paper 15*a*.

If some of the PW shutter plates are open, the PW shutter plate drive motor 61 is driven a specific amount (step S11). More specifically, all suction holes in the second suction area 25 and third suction area 26 are closed. After confirming the motor 61 has driven the specified amount, driving the PW shutter plate drive motor 61 stops (step S12).

Suction control while printing is described next with reference to the flow chart in FIG. 8 while also referring to FIG. 1 to FIG. 5.

Figure 8:
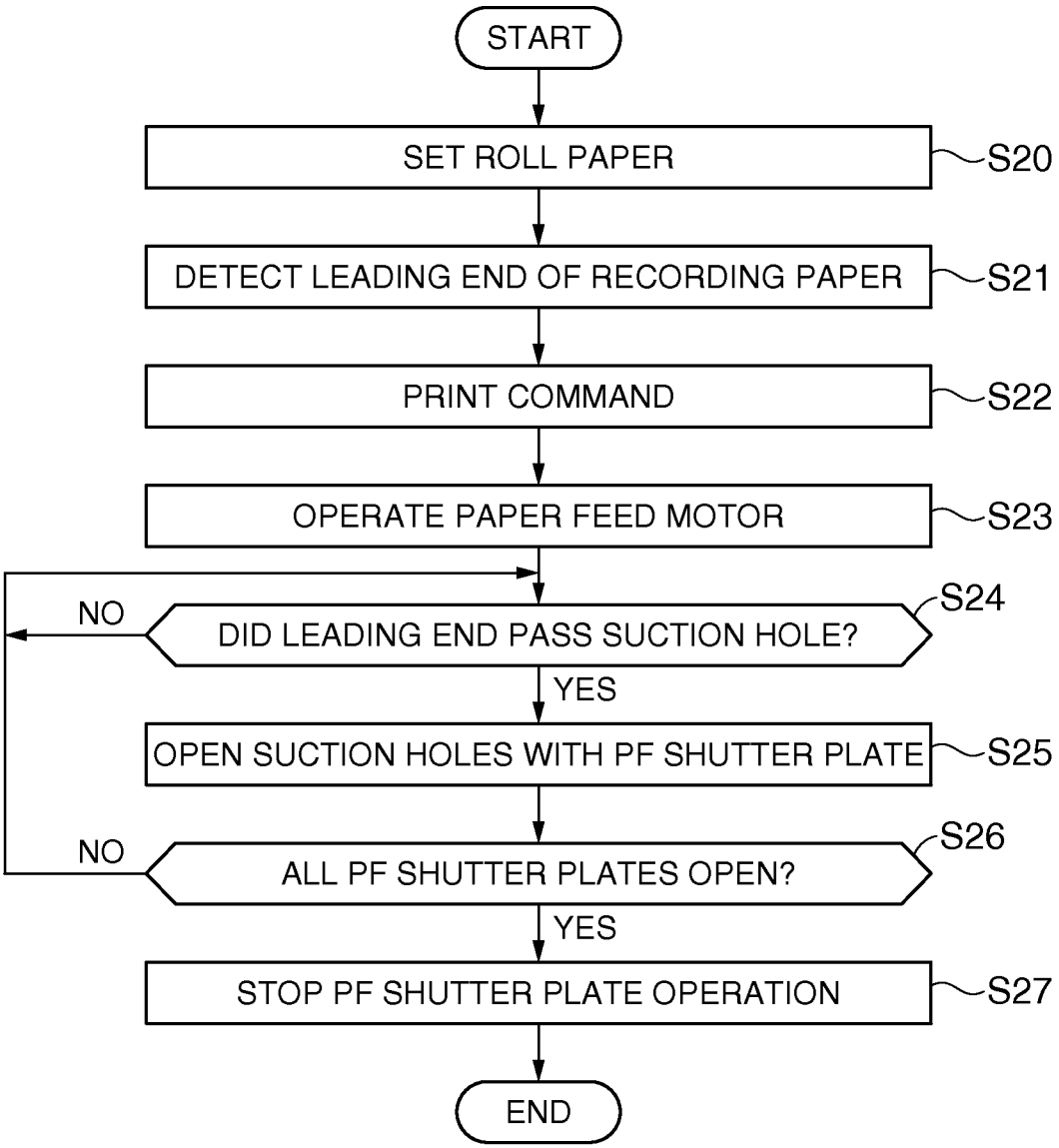
FIG. 8 is a flow chart of the method used to determine the open area of the suction holes based on the forward conveyance position of the recording paper during printing.

FIG. 8 is a flow chart of the process determining the suction hole areas to open and close according to the recording paper conveyance position in the forward direction while printing.

The roll paper 15 is first set on the roll paper drive shaft 13 (step S20). The areas of the open suction holes in the PW shutter plate are previously determined according to the roll paper 15 width in this example. After the roll paper 15 is set, the recording paper 15*a* is automatically fed forward and the leading end of the paper is detected with the recording paper position detection sensor 17 (step S21).

After the leading end of the recording paper is detected, a print command is output and printing starts (step S22). Based on this print command, the paper feed motor for driving the paper feed roller 9 is operated to convey the recording paper 15*a* forward while printing with the inkjet head 3 (step S23).

The lateral rows of suction holes passed by the leading end of the recording paper 15*a* is then detected (step S24). The lateral rows of suction holes passed by the recording paper 15*a* are calculated using the positions of the suction hole openings, the hole diameter, and the conveyance distance. The positions of the suction hole openings can be calculated from the position of the leading end of the recording paper detected by the recording paper position detection sensor 17 and the design (such as pitch) of the hole openings. The conveyance distance of the recording paper 15*a* is determined using a rotary encoder disposed in the paper feed roller 9 or paper feed motor.

When the leading end of the recording paper 15*a* is detected to pass a specific single lateral row (step S24 returns YES) and all suction holes in that row are covered by the recording paper 15*a*, the PF shutter plate for opening and closing that row is operated to open the row of suction holes that the leading end of the recording paper 15*a* passed (step S25).

For example, if the recording paper 15*a* passes the suction holes in row B1, PF shutter plate 71 is operated to open suction holes 25*a*, 25*j*, 24*a*, 26*a*, 26*j*. The suction holes in the longitudinal rows not opened by the PW shutter plates at this time are not opened. The suction holes in the lateral rows other than row B1 remain closed. The recording paper 15*a* is then further conveyed and when passing row C1 is detected, PF shutter plate 81 is operated to open the suction holes 25*f*, 24*b*, 24*c*, 26*f* in row C1.

Each time the recording paper 15*a* passes another lateral row of suction holes, the corresponding PF shutter plate is operated and the suction holes in that row are opened.

If step S24 determines that the leading end of the recording paper 15*a* has not passed any suction holes, conveying the recording paper 15*a* continues until a lateral row of suction holes is passed.

Whether the leading end of the recording paper 15*a* has passed the suction holes in lateral rows B2, C2, to B5 is then detected (step S26). More specifically, if all PF shutter plates are determined to have opened the suction holes in the lateral rows (step S26 returns YES), operating the PF shutter plates (operating the PF shutter motor 62) stops (step S27). If some of the PF shutter plates have still not opened the corresponding lateral row of suction holes (step S26 returns NO), control returns to step S24 until step S27 executes.

Suction control when the recording paper 15*a* is reversed from the position left in the last step S27 is described next with reference to the flow chart in FIG. 9.

Figure 9:
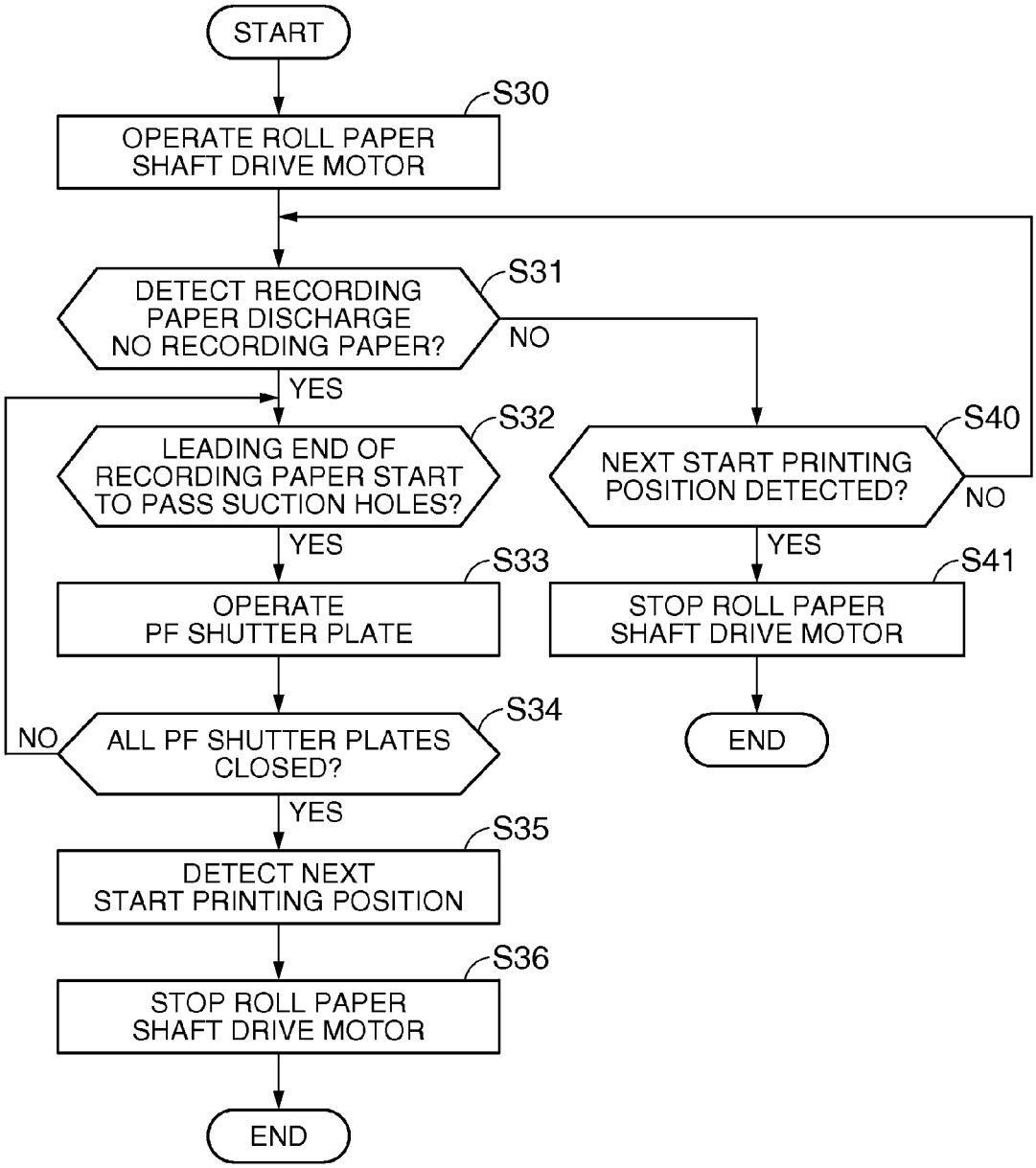
FIG. 9 is a flow chart of the method used to determine the open area of the suction holes based on the conveyance position of the recording paper when the recording paper is being reversed.

FIG. 9 is a flow chart of the process determining suction hole areas that are opened and closed according to the recording paper conveyance position during reverse conveyance. The roll paper shaft drive motor is operated to back feed the paper (step S30).

Discharge of the recording paper 15*a* is then detected (step S31). If this step determines that the recording paper 15*a* was not discharged (step S31 returns YES), operating the roll paper shaft drive motor continues to back feed the roll paper 15. When the leading end of the paper is confirmed to begin passing a lateral row of suction holes (step S32), the corresponding PF shutter plate operates to close those holes (step S33). For example, when the leading end of the recording paper begins to pass the suction holes in row B5, PF shutter plate 84 is operated to close the suction holes in row B5. As the leading end of the recording paper is reversed, the PF shutter plates for rows C4, B4 and so forth operate and sequentially close the suction holes in the corresponding lateral rows.

Whether all lateral rows of suction holes have been closed by all PF shutter plates is then detected (step S34). If not all rows have been closed (step S34 returns No), steps S32 to S34 repeat.

If the lateral rows of suction holes have been closed by all of the PF shutter plates (step S34 returns Yes), conveying the recording paper 15*a* continues until the next start printing position is detected (step S35), and operating the roll paper shaft drive motor then stops (step S36).

If recording paper discharge detection in step S31 determines paper is present (step S31 returns NO), the next start printing position is detected at the recording paper conveyance position (step S40). When the detected position is at the next start printing position (YES), operating the roll paper shaft drive motor stops (step S41).

If the detected position in step S40 is not the next start printing position (NO), reversing the recording paper 15*a* continues until the recording paper 15*a* reaches the next start printing position.

In the printer 1 described above, the suction holes in the area where the recording paper 15*a* covers the suction holes are opened by the first PF shutter plate group 70, second PF shutter plate group 80, and PW shutter plate group 100, and the recording paper 15*a* is pulled to the surface of the platen 21.

In the area where the suction holes are not covered by the recording paper 15*a* (that is, the area where the suction holes are open), suction is not applied to the recording paper 15*a* by closing the suction holes with the first PF shutter plate group 70, second PF shutter plate group 80, and PW shutter plate group 100.

Because loss of suction pressure is suppressed and sufficient suction pressure can therefore be achieved, a drop in print quality caused by the recording paper lifting up and the platen gap varying can be prevented, and the recording paper rubbing against the liquid ejection head and becoming soiled with ink can be prevented even when using narrow recording paper or stiff recording paper.

The effect described above can be achieved by not producing suction through the suction holes where the recording paper 15*a* is not present, and producing suction only where the recording paper 15*a* is. More specifically, the opening/closing mechanism 20 (open/close drive unit 60) is controlled to open the suction holes after the recording paper 15*a* passes those suction holes (when the suction holes are covered by the recording paper 15*a*). Suction at the leading end of the recording paper in particular must be avoided when the suction holes are not covered by the recording paper.

The timing when the opening/closing mechanism 20 starts operating must be accurately controlled based on the position of the leading end of the recording paper immediately before printing starts, the state of the opening/closing mechanism 20, and the next printing speed (paper feed speed). This is further described below.

Figure 10A:
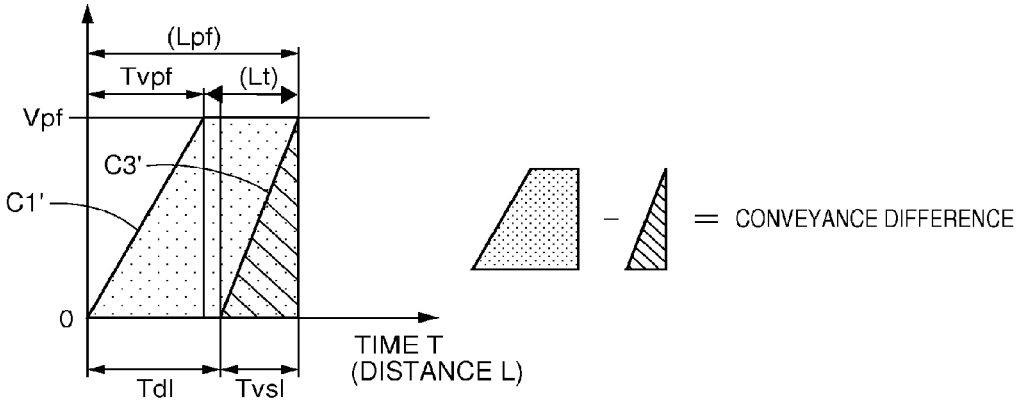
FIGS. 10A-10C schematically describe the delay in the startup timing of the opening and closing mechanism relative to the position of the leading end of the recording paper.
Figure 10B:
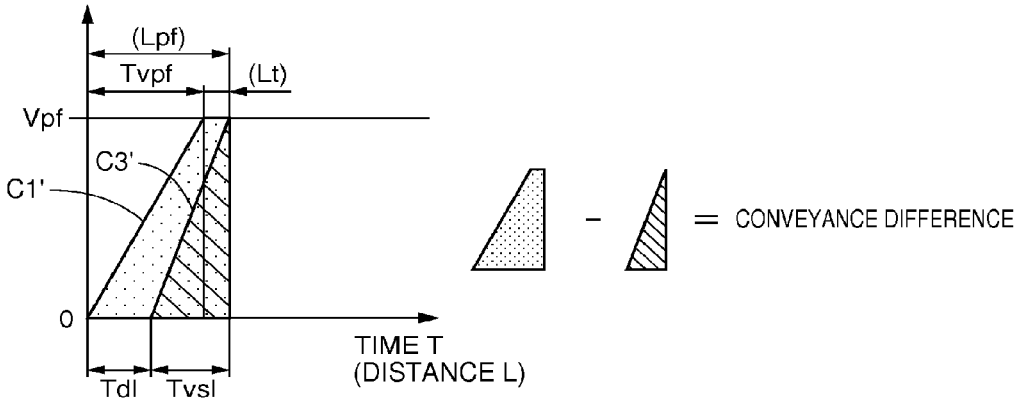
Figure 10C:
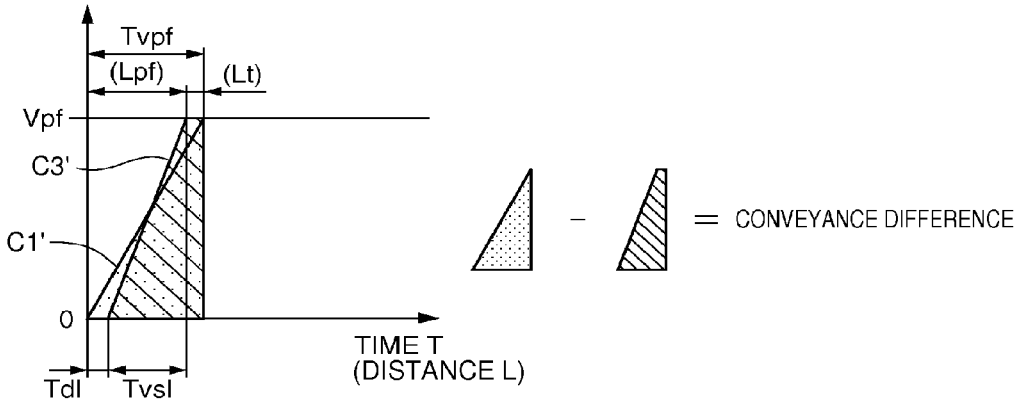

FIGS. 10A-10C describe the delay in the startup timing of the opening/closing mechanism 20 relative to the position of the leading end of the recording paper. Note that the startup timing of the opening/closing mechanism 20 is the startup timing of the PF shutter motor 62 when closing the lateral rows B1 to B5 and C1 to C4 of suction holes with the PF shutter plate groups 70 and 80.

There are three patterns for paper feed and driving the opening/closing mechanism 20 (opening and closing the suction holes) as described below, and the method of calculating the delay time (or startup time) differs in each pattern.

FIG. 10A describes pattern (A) in which the opening/closing mechanism 20 starts operating after accelerating conveyance of the recording paper 15*a* ends.

FIG. 10B describes pattern (B) in which the opening/closing mechanism 20 starts operating while conveyance of the recording paper 15*a* is accelerating, and the opening/closing mechanism 20 finishes opening the suction holes after acceleration of recording paper 15*a* conveyance ends.

FIG. 10C describes pattern (C) in which the opening/closing mechanism 20 starts operating while conveyance of the recording paper 15*a* is accelerating, and the opening/closing mechanism 20 finishes opening the suction holes before acceleration of recording paper 15*a* conveyance ends.

In FIG. 10A to FIG. 10C, Tvpf is the paper feed (conveyance) acceleration time, Tvsl is the time until the suction holes in the opening/closing mechanism 20 are open, Vpf is the paper feed speed after paper feed stops accelerating, and Tdl is the delay from when paper feed starts to when the opening/closing mechanism 20 starts operating.

Pattern (A) in FIG. 10A is described first. In pattern (A), the opening/closing mechanism 20 starts after accelerating conveyance of the recording paper 15*a* ends, and as shown in FIG. 10A, can be expressed as Tdl−Tvpf≥0. The conveyance distance during acceleration, and the conveyance distance of the recording paper 15*a* until the suction holes in the opening/closing mechanism 20 are open, can be expressed by the following equation.

$$\text{paper feed length } Lpf=Nvpf\times C1'+Vpf\times(Tvsl+Tdl-Tvpf) \quad (1)$$

The delay time Tdl can be calculated from equation (1). This equation (1) is referred to below as equation A.

Note that Nvpf is the conveyance distance during the paper feed acceleration time Tvpf, and C1' is an acceleration function. The conveyance distance is the output of the rotary encoder disposed in the paper feed motor 9*a*, and is the encoder pulse (EP) count when the smallest unit of rotary encoder resolution is 1 EP.

Movement Lsl during the time Tvsl required for the suction holes of the opening/closing mechanism 20 to open can be expressed by the following equation.

$$Lsl=Nvsl\times C3' \quad (2)$$

where Nvsl is the movement during the time Tvsl required for the suction holes to open, and C3 is an acceleration function. This movement is the output of the rotary encoder disposed in the PF shutter motor 62, and is the encoder pulse (EP) count when the smallest unit of rotary encoder resolution is 1 EP.

As a result, if the opening/closing mechanism 20 starts operating when the end of paper feed acceleration coincides with the suction holes opening, or within a specific range of this target value, the opening/closing mechanism 20 can be controlled so that the suction holes open after the recording paper 15*a* passes the suction holes (when the roll paper 15 has covered the suction holes). If Lt is the target value of the difference (paper feed difference) between the end of paper feed acceleration and the end of suction hole opening, this target value Lt can be calculated as follows.

$$Lt=Lpf-Lsl \quad (3)$$

The opening/closing mechanism 20 can therefore be started at a startup time (delay time Tdl) satisfying the conditions of the target value Lt for this difference.

Note that the delay time Tdl can be expressed using the EP count as Ndl. More specifically, the opening/closing mechanism 20 can be started after a specific EP count is output by the rotary encoder disposed in the PF shutter motor 62.

Pattern (B) in FIG. 10B is described next. Pattern (B) applies when the opening/closing mechanism 20 starts while conveyance of the recording paper 15*a* is accelerating, and the suction holes of the opening/closing mechanism 20 finish opening after acceleration of recording paper 15*a* conveyance ends, and as shown in FIG. 10B, can be expressed as Tdl+Tvsl≥Tvpf. The conveyance distance (paper feed length) while paper feed is accelerating, and the paper feed length Lpf of the recording paper 15*a* until the suction holes of the opening/closing mechanism 20 finish opening, can be expressed by the following equation.

$$Lpf=Nvpf\times C1'+Vpf\times(Tvsl+Tdl-Tvpf) \quad (4)$$

This equation (4) is referred to as equation B.

Paper feed length Lsl during the time Tvsl required for the suction holes of the opening/closing mechanism 20 to open can be expressed by the following equation.

$$Lsl=Nvsl\times C3' \quad (5)$$

As a result, if the opening/closing mechanism 20 starts operating when the end of paper feed acceleration coincides with the suction holes opening, or within a specific range of this target value, the opening/closing mechanism 20 can be controlled so that the suction holes open after the recording paper 15*a* passes the suction holes (when the roll paper 15 has covered the suction holes). If Lt is the target value of the difference (paper feed difference) between the end of paper feed acceleration and the end of suction hole opening, this target value Lt can be calculated as follows.

$$Lt=Lpf-Lsl \quad (6)$$

The opening/closing mechanism 20 can therefore be started at a startup time (delay time Tdl or Ndl) satisfying the conditions of the target value Lt for this difference.

Pattern (C) in FIG. 10C is described next. Pattern (C) applies when the opening/closing mechanism 20 starts while conveyance of the recording paper 15*a* is accelerating, and the suction holes of the opening/closing mechanism 20 finish opening before acceleration of recording paper 15*a* conveyance ends, and as shown in FIG. 10C can be expressed as Tdl+Tvsl≤Tvpf. The conveyance distance (paper feed length) while paper feed is accelerating can be expressed by the following equation.

$$\text{paper feed length } Lpf=Tvpf\times C1' \quad (7)$$

The paper feed length Lsl during the time Tvsl until the suction holes of the opening/closing mechanism 20 open can be expressed by the following equation.

$$Lsl=Nvsl\times C3'+Vpf\times(Tvpf-Tvsl-Tdl) \quad (8)$$

The delay time Tdl can be calculated from equation (8). Equation (8) is referred to as equation C.

As a result, if the opening/closing mechanism 20 starts operating when the end of paper feed acceleration coincides with the suction holes opening, or within a specific range of this target value, the opening/closing mechanism 20 can be controlled so that the suction holes open after the recording paper 15*a* passes the suction holes (when the roll paper 15 has covered the suction holes). If Lt is the target value of the difference (paper feed difference) between the end of paper feed acceleration and the end of suction hole opening, this target value Lt can be calculated as follows.

$$Lt=Lpf-Lsl \quad (9)$$

The opening/closing mechanism 20 can therefore be started at a startup time (delay time Tdl or Ndl) satisfying the conditions of the target value Lt for this difference.

A method of determining the startup time using the above equations is described next.

Figure 11:
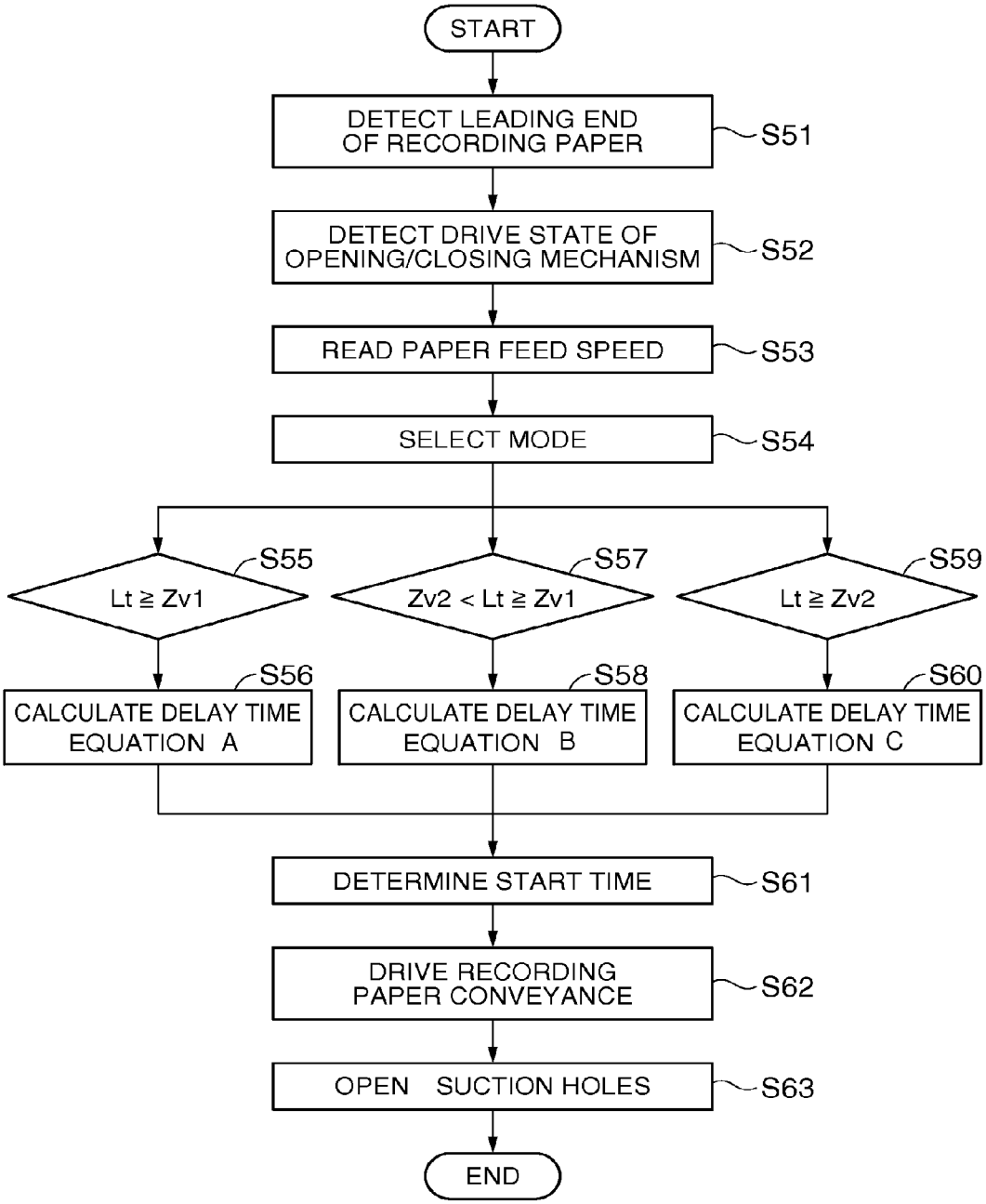
FIG. 11 is a flow chart of the main steps used to determine the startup timing.

FIG. 11 is a flow chart of main steps in a process for determining the startup time.

The position of the leading end of the recording paper 15*a* immediately before paper feed starts is first detected (step S51). As described above, the leading end of the recording paper is detected by the leading end position detection unit 18 disposed at the downstream side in the conveyance direction of the recording paper 15*a*, and the recording paper position detection sensor 17 that is disposed at the upstream side and detects the start printing reference position. After the position of the leading end is detected, control goes to step S52.

The drive state of the first PF shutter plate group 70 in the opening/closing mechanism 20 is then detected (step S52). For example, information indicating whether the first PF shutter plate group 70 has closed row B1 in the lateral rows of suction holes, or has closed rows B1 and C1, is obtained from the output of the rotary encoder disposed in the PF shutter motor 62.

The paper feed speed Vpf of the recording paper 15*a* is then read (step S53). The paper feed speed Vpf is determined by the print command from the host device 201 (see FIG. 6).

The operating mode is then selected (step S54). Selecting the operating mode determines if (A) the opening/closing mechanism 20 starts operating after accelerating conveyance of the recording paper 15*a* ends; (B) the opening/closing mechanism 20 starts operating while conveyance of the recording paper 15*a* is accelerating, and the opening/closing mechanism 20 finishes opening the suction holes after acceleration of recording paper 15*a* conveyance ends; or (C) the opening/closing mechanism 20 starts operating while conveyance of the recording paper 15*a* is accelerating, and the opening/closing mechanism 20 finishes opening the suction holes before acceleration of recording paper 15*a* conveyance ends.

When mode (A) is selected, control goes to step S55. In mode (A), $Lt \geq Zv1$.

Zv1 is a first threshold value, and is equal to the upper design limit of the target delay value Lt. More specifically, Zv1 is the value where $Lt \geq (Nvpf - Nvsl + Nvsl \times Vpf)$.

The delay time Tdl (Ndl) of the opening/closing mechanism 20 to the start of recording paper conveyance is then calculated using equation A based on the leading end position information for the recording paper, the state of the opening/closing mechanism 20, and the paper feed speed (step S56).

The start time of the opening/closing mechanism 20 is then determined based on the delay time Tdl (Ndl) (step S61), and driving recording paper conveyance starts (step S62). The PF shutter plate group 70 is then driven to open the suction holes to be opened (step S63), and the recording paper 15*a* is pulled to the platen.

When mode (B) is selected, control goes to step S57. In mode (B), $Zv2 \leq Lt \geq Zv1$. Zv1 is a first threshold value, and Zv2 is a second threshold value. The second threshold value Zv2 is equal to the difference between the paper feed length Nvpf while paper feed is accelerating, and the length Nvsl until the suction holes open.

As a result, $(Nvpf - Nvsl) < Lt \geq (Nvpf - Nvsl + Tvsl \times Vpf)$.

The delay time Tdl of the opening/closing mechanism 20 to the start of recording paper conveyance is then calculated using equation B based on the leading end position information for the recording paper, the state of the opening/closing mechanism 20, and the paper feed speed (step S58).

The start time of the opening/closing mechanism 20 is then determined based on the delay time Tdl (step S61), and driving recording paper conveyance starts (step S62). The PF shutter plate group 70 is then driven to open the suction holes to be opened (step S63), and the recording paper 15*a* is pulled (suctioned) to the platen.

When mode (C) is selected, control goes to step S59. In mode (C), $Lt \geq Zv2$. Zv2 is a second threshold value.

As a result, $Lt \geq (Nvpf - Nvsl)$.

The delay time Tdl of the opening/closing mechanism 20 to the start of recording paper conveyance is then calculated using equation C based on the leading end position information for the recording paper, the state of the opening/closing mechanism 20, and the paper feed speed (step S60).

The start time of the opening/closing mechanism 20 is then determined based on the delay time Tdl (step S61), and driving recording paper conveyance starts (step S62). The PF shutter plate group 70 is then driven to open the suction holes to be opened (step S63), and the recording paper 15*a* is pulled (suctioned) to the platen.

The start time of the opening/closing mechanism 20 sets the delay Tdl from the start of recording paper conveyance to the start of opening the suction holes to within a specific range of difference Lt bounded by the first threshold value Zv1 and second threshold value Zv2. The start time can therefore be determined from the speed and conveyance distance information acquired from the rotary encoder disposed in the paper feed motor 9*a*, and the speed and conveyance distance information acquired from the rotary encoder disposed in the PF shutter motor 62 that controls driving the PF shutter plate group 70.

Note that the difference Lt is set to one of three modes (A), (B), (C) in the mode selection step (S54), and the delay time Tdl (or equivalent EP count Ndl, as explained above) is calculated and the start time determined using a different equation A, B, and C in each mode. However, the paper feed acceleration time Tvpf (or paper feed length Nvpf during that time) and the time Tvsl until the suction holes open that are used as parameters in equations A to C can be compiled in a table keyed to the printing speed (paper feed speed Vpf) set in the input print command, and the acceleration time Tvpf (or Nvpf) and the time Tvsl until the suction holes open can be extracted from the table for use in the calculations. Examples of such tables are shown in Table 1 and Table 2 below.

Table 1 shows parameters for the paper feed system, and Table 2 shows parameters for the opening/closing mechanism.

TABLE 1

| paper feed speed Vpf (mm/s) | EP count during acceleration Nvpf (EP) | acceleration time Tvpf (ms) |
|---|---|---|
| 300 | 1700 | 182 |
| 150 | 600 | 107 |
| 75 | 580 | 210.45 |

Referring to Table 1, if the paper feed speed Vpf is 75 mm/s, an EP count during acceleration Nvpf of 580, and an acceleration time Tvpf of 210.45 ms, can be extracted as the parameters to use to calculate the start time.

TABLE 2

| shutter speed Vsl (mm/s) | EP count required Nvsl (EP) | time until suction holes open Tvsl (ms) |
|---|---|---|
| 300 | 1480 | 74.7 |
| 150 | 420 | 37.7 |
| 75 | 173 | 28.0 |

Referring to Table 2, if the shutter speed Vsl is 75 mm/s, a required EP count Nvsl of 173, and time-until-suction-holes-open Tvsl of 28.0 ms, can be extracted as the parameters to use to calculate the start time.

The printer 1 described above calculates the delay (Tdl or Ndl) until the opening/closing mechanism starts operating from the start of recording paper 15*a* conveyance based on information about the position of the leading end of the recording paper, the drive state of the opening/closing mechanism 20 (that is, the open or closed states of the suction holes), and the next paper feed speed, determines the timing when the opening/closing mechanism 20 starts operating based on this delay time, starts the opening/closing mechanism 20 at this starting time, and opens the suction holes after the suction holes are covered by the recording paper 15*a*. Because suction is therefore applied to the recording paper 15*a* at the leading end of the recording paper 15*a* only in the area where the suction holes are covered by the recording paper 15*a*, ink or other fluid droplets will not be scattered by the suction current, and good print quality can be achieved.

Furthermore, if the opening/closing mechanism 20 is started so that the difference Lt between the time when paper feed acceleration ends and the time when opening the suction holes in the opening/closing mechanism 20 ends is within a specific range of a target value, conveying the recording paper 15*a* and driving the opening/closing mechanism 20 can be controlled to substantially match, and suction can be applied to the recording paper 15*a* using only the suction holes where the recording paper 15*a* is present.

When printing, there are three modes (A), (B), and (C) that describe the start of recording paper conveyance and the start or end of opening/closing mechanism 20 operation. By using an equation (equation A, equation B, equation C) specific to each mode, a delay time Tdl or delay amount Ndl that satisfies the conditions of the specific equations can be calculated, and the opening/closing mechanism 20 can be started at the appropriate time.

In addition, the start time of the opening/closing mechanism 20 is determined from the paper feed length Nvpf during acceleration of the recording paper 15*a*, and the movement Nvsl while the suction holes of the opening/closing mechanism 20 are opening. Because the paper feed speed (print speed) of the recording paper 15*a* may vary with the print command, the start time can be calculated from the paper feed speed Vpf, the paper feed length Nvpf during recording paper 15*a* acceleration, and the movement Nvsl while the suction holes of the opening/closing mechanism 20 are opening.

Furthermore, because the paper feed speed Vpf, paper feed acceleration time Tvpf, and time Tvsl until the suction holes open are known values, these calculation parameters can be compiled in a table according to the paper feed speed, and once the position of the leading end of the recording paper 15*a*, the operating state of the opening/closing mechanism 20, and the paper feed speed information are acquired, the delay amount Ndl can be easily calculated.

The invention being thus described, it will be apparent that it may be varied in many ways. Such variations are not to be regarded as a departure from the spirit and scope of the invention, and all such modifications as would be apparent to one skilled in the art are intended to be included within the scope of the following claims.

What is claimed is:

1. A control method for a printing device that has a fluid ejection head, a plurality of suction holes disposed in a recording paper conveyance direction opposite the fluid ejection head, and an opening/closing mechanism that opens and closes the plurality of suction holes, comprising:

detecting a position of a leading end of the recording paper before starting recording paper conveyance;

reading a next recording paper conveyance speed;

calculating a delay time for starting the opening/closing mechanism after recording paper conveyance starts based on the position of the leading end of the recording paper and the recording paper conveyance speed;

determining a start time when the opening/closing mechanism starts operating based on the delay time; and starting the opening/closing mechanism at the start time and opening the plurality of suction holes;

wherein calculating the delay time uses parameter values extracted from a table containing a paper feed length during acceleration, and a paper conveyance acceleration time, at selected conveyance speeds, and a table containing an amount a paper feed motor is driven until the plurality of suction holes open, and a time until the plurality of suction holes open, at each operating speed of the opening/closing mechanism.

2. The control method of a printing device described in claim 1, wherein:

the start time of the opening/closing mechanism is selected to maintain a value of a difference between a position of the paper at the end of the paper conveyance acceleration time and a position of the paper when the plurality of suction holes are open within a specific range of a target value.

3. The control method of a printing device described in claim 1, wherein:

calculating the delay time includes using a different equation in each of the following cases, (A) when the opening/closing mechanism starts operating after acceleration of recording paper conveyance ends, (B) when the opening/closing mechanism starts operating during acceleration of recording paper conveyance, and the opening/closing mechanism finishes opening the plurality of suction holes after acceleration of recording paper conveyance ends, and (C) when the opening/closing mechanism operates during acceleration of recording paper conveyance, and the opening/closing mechanism finishes opening the plurality of suction holes before acceleration of recording paper conveyance ends.

4. The control method of a printing device described in claim 1, wherein:

determining the start time uses a recording paper conveyance distance during acceleration of recording paper conveyance, and movement of the opening/closing mechanism until the plurality of suction holes open.

5. A printing device comprising:

a fluid ejection head;

a platen disposed opposite the fluid ejection head with a plurality of suction holes formed in a matrix pattern in a recording paper conveyance direction;

a suction mechanism that pulls a recording paper to a surface of the platen through the plurality of suction holes;

an opening/closing mechanism that is disposed between the platen and the suction mechanism, opens suction holes in an area covered by the recording paper, and closes suction holes in an area not covered by the recording paper:

a position detection sensor that detects a position of a leading end of the recording paper;

a start time determination unit that determines a time when the opening/closing mechanism starts operating; and a controller that calculates a delay time for starting the opening/closing mechanism after recording paper conveyance starts based on the position of the leading end of the recording paper and a recording paper conveyance speed, adjusts the time when the opening/closing mechanism starts operating based on the delay time, and starts the opening/closing mechanism at the start time and opens the plurality of suction holes;

wherein the controller compiles a table containing a paper feed length during acceleration, and a conveyance acceleration time, at selected conveyance speeds, and a table containing an amount a paper feed motor is driven until the plurality of suction holes open, and a time until the plurality of suction holes open, at each operating speed of the opening/closing mechanism, and calculates the delay time using parameter values extracted from the tables.

6. The printing device described in claim 5, wherein:

the controller sets the start time of the opening/closing mechanism to maintain a value of a difference between a position of the paper at the end of a paper conveyance acceleration time and a position of the paper when the plurality of suction holes are open within a specific range of a target value.

7. The printing device described in claim 5, wherein:

the controller determines the start time based on a recording paper conveyance distance during acceleration of recording paper conveyance, and movement of the opening/closing mechanism until the plurality of suction holes open.

8. A printing device comprising:

a fluid ejection head;

a platen disposed opposite the fluid ejection head with a plurality of suction holes formed therein;

a suction mechanism that pulls a recording paper to a surface of the platen through the plurality of suction holes;

an opening/closing mechanism that opens suction holes in an area covered by the recording paper, and closes suction holes in an area not covered by the recording paper; and a controller that operates the opening/closing mechanism by compiling a table containing a paper feed length during acceleration and a conveyance acceleration time at selected conveyance speeds;

compiling a table containing an amount a paper feed motor is driven until the plurality of suction holes open and a time until the plurality of suction holes are open, at each operating speed of the opening/closing mechanism; and calculating timing for operating the opening/closing mechanism using parameter values extracted from the tables.

* * * * *